United States Patent [19]

Faehling et al.

[11] 4,184,475

[45] Jan. 22, 1980

[54] FIREPLACE

[75] Inventors: Francis L. Faehling; Thomas F. Billmeyer; Robert G. Moss, all of Wisconsin Rapids, Wis.

[73] Assignee: Preway Inc., Wisconsin Rapids, Wis.

[21] Appl. No.: 815,066

[22] Filed: Jul. 12, 1977

[51] Int. Cl.[2] ..... F24B 7/00

[52] U.S. Cl. ..... 126/121; 126/288

[58] Field of Search ..... 126/288, 121, 129, 131, 126/296, 286, 287; 49/109

[56] References Cited

U.S. PATENT DOCUMENTS

| | | | |
|---|---|---|---|
| 47,945 | 5/1885 | Greenleaf | 126/296 X |
| 978,227 | 12/1910 | Sholar | 126/288 X |
| 1,722,801 | 7/1929 | Kelm | 126/296 |
| 2,322,016 | 6/1943 | Hardeman | 126/121 X |
| 2,569,624 | 10/1951 | Wychowaniec et al. | 49/109 |
| 2,863,443 | 12/1958 | Hoffman | 126/121 U X |
| 3,180,332 | 4/1965 | Grushkin | 126/121 |
| 4,004,731 | 1/1977 | Zung | 126/121 X |
| 4,025,043 | 5/1977 | Cleer | 126/121 X |
| 4,074,679 | 2/1978 | Jensen | 126/121 |

*Primary Examiner*—Dennis L. Taylor

*Attorney, Agent, or Firm*—Wegner, Stellman, McCord, Wiles & Wood

[57] ABSTRACT

A fireplace having passage means for directing outside combustion air into the firebox with a pair of outlet openings for said combustion air and each having an intake damper movable between open and closed positions at the outlet end of said passage means with operating structure for positioning of said intake dampers including handle means disposed at the front of the fireplace.

2 Claims, 3 Drawing Figures

10
11
23
31
41
16
47
2.
40
32
15
25
30
60
63
48
57
20
45
55
21
21a
22
56
46
2.

49
40
50
46
30
21
45
56
55
46

3.
40
49
46
30
50
45
25
55
62
61
60
56
46
3.

FIREPLACE

BACKGROUND OF THE INVENTION

This invention pertains to fireplaces such as those disclosed in an Application Ser. No. 604,613 filed Aug. 14, 1975, now Pat. No. 4,095,581, wherein a fireplace is constructed for delivery of outside air into the firebox to facilitate combustion. The use of the outside air for combustion may be optional but is desirable and sometimes required when door means are associated with the fireplace for closing the front opening of the fireplace.

It is known in the art to have fireplaces with passage means for directing outside air to the firebox for combustion. In such a fireplace there is a flow of outside air to the firebox whether or not the fireplace is in use. When the fireplace is not being used, this connection of the passage means to the exterior can cause cold drafts which are objectionable to persons occupying the space or area of the room adjacent to the fireplace. Applicants are not aware of any fireplace structure wherein passage means built into the fireplace supplies external air for combustion and has an intake damper operable from the front of the fireplace whereby the passage means may be closed to avoid drafts and may be opened when there is a fire in the fireplace to permit delivery of the external air to the fire.

SUMMARY

A primary feature of the invention disclosed herein is to provide a fireplace having passage means for supplying external outside air to the firebox for use in combustion and with means operable from the front of the fireplace for closing the passage means except when the fireplace is in use.

In carrying out the foregoing feature of the invention a primary object is to provide a fireplace having a firebox with passage means extended thereto for delivering external air to the firebox and with an intake damper associated with the passage means and with operating means connected to the intake damper and having handle means at the front of the fireplace for controlling the position of the intake damper.

Still another object of the invention is to provide a fireplace of the type defined in the preceeding paragraph wherein the passage means has a pair of outlets in opposite wall sections of the firebox with each of said outlets having an itake damper and with the operating means including a pair or rotatable rods associated one with each of said intake dampers and interconnected by a link whereby longitudinal movement of the link causes rotation of the rods to position the intake dampers, and said link has a handle member exposed at the front of the fireplace for causing the linear movement thereof.

DESCRIPTION OF THE PREFERRED EMBODIMENT

Figures 1, 2, 3:
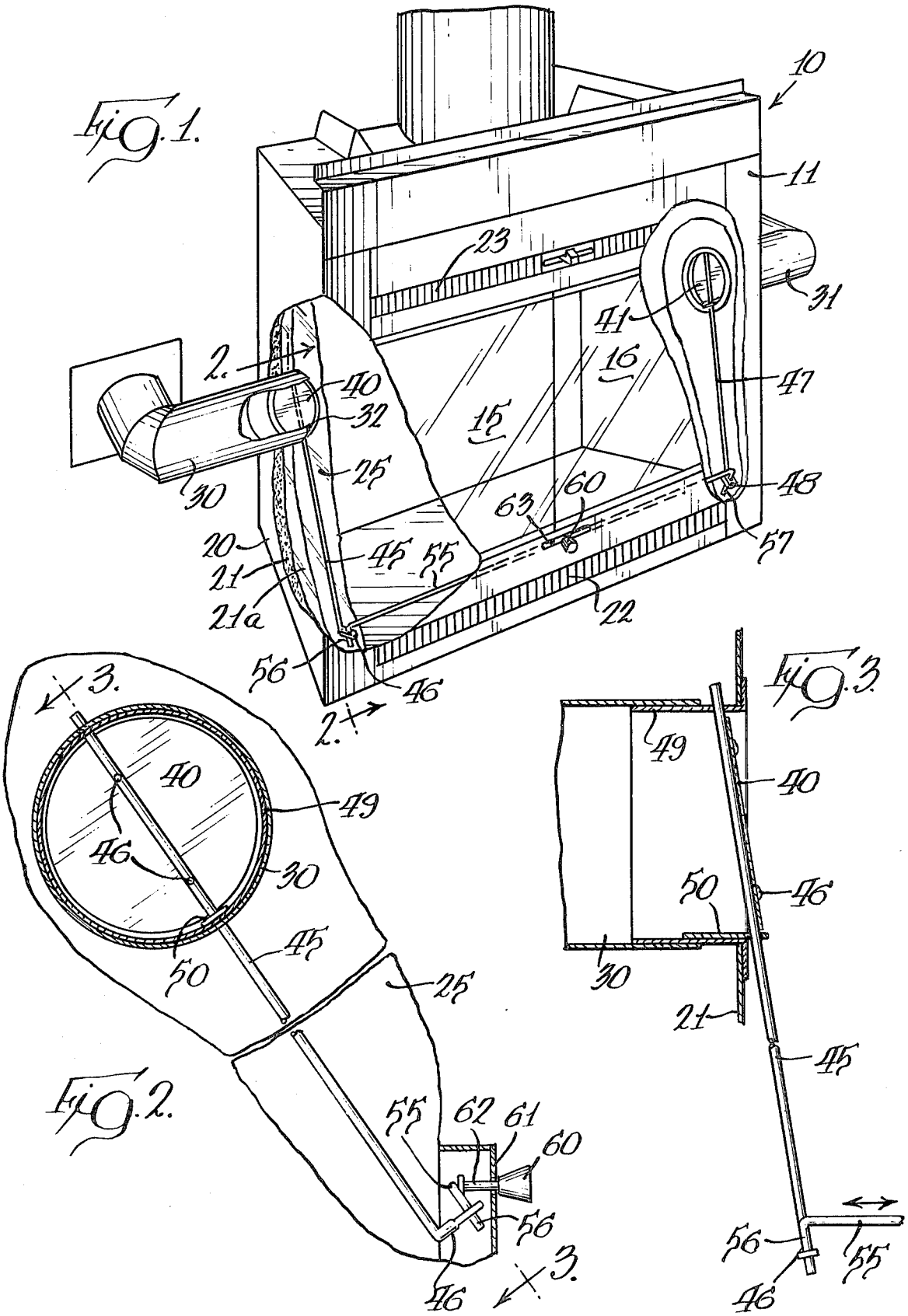
FIG. 1 is a front perspective view of the fireplace showing the external air passage means associated therewith and with parts broken away.
FIG. 2 is a fragmentary sectional view on an enlarged scale taken generally along the line 2—2 in FIG. 1.
FIG. 3 is a sectional view taken generally along the line 3—3 in FIG. 2.

The fireplace is shown generally in FIG. 1 and has a casing 10 of a construction now generally well-known in the art with a front wall 11 having a front opening which may be closed, if desired, by a pair of transparent doors 15 and 16. The casing has a multi-wall construction with an external walls 20 and an intermediate wall 21 having insulation therebetween. The wall 21 and an interior wall 21*a* define a circulating air space therebetween whereby room air may enter through a lower grill 22 and flow between the walls 21 and 21*a* for return to the room through an upper grill 23. This general structure is shown in application Ser. No. 777,063 filed Mar. 14, 1977. The interior wall 21*a* defines a firebox wall with an additional side panel 25 forming a heat shield member and guiding the flow of external combustion air to the lower side of the firebox. There is a wall 25 at each side of the firebox and they are comparable in function to the baffle 150 in the application Serial No. 604,613 referred to above.

The fireplace is normally built in to an enclosure but, for clarity, is shown free-standing in FIG. 1

The passage means for directing external air to the fireplace for combustion includes a pair of tubular conduits 30 and 31 which can extend to an outside wall of the house or other structure for receiving outside air and each having an outlet opening 32 in the firebox wall 21.

With the construction described it will be seen that outside air may flow through the conduits 30 and 31 and out of opposed outlets 32 at opposite side of the firebox for flow downwardly between the wall 21 and the side panels 25 for delivery to the lower part of the firebox to assist in combustion. The fireplace may have a mesh screen positioned in the front opening or the door means 15 and 16 previously referred to. With the mesh screen there is an extreme draft condition with the conduits 30 and 31 being opened to the outside and there can also be a draft condition even with the door means because of the cold outside air keeping the fireplace walls cold and with the limited circulation of air through the grills 22 and 23 and the contact of the air with the cold walls of the fireplace.

The invention disclosed herein relates to the use of an intake damper operable from the front of the fireplace for control of outside air and, more particularly, intake dampers associated with the outlets 32 of the passage means with there being a pair of the intake dampers identified at 40 and 41. The intake dampers are movable between open and closed positions. The side panels 25 are spaced a sufficient distance from the outlet of the passage means whereby the dampers 40 and 41 can move to an open position. Referring particulary to the damper 40 it is attached to a rotatable rod 45, by attachment means 46, with the rotatable rod 45 extending forwardly and downwardly and terminating in a bent end 46 having an opening. The intake damper 41 is similarly attached to a rotatable rod 47 having a bent end 48 with an opening. Each of the rods 45 and 47 are rotatably mounted on the conduit means associated therewith and as shown in FIGS. 2 and 3. The rod 45 extends through an opening in the wall of a collar 49 at the end of the conduit 30 and through a tab 5 secured to the collar 49 whereby the rod may angle inwardly as well as downwardly and forwardly. This direction of the rod is permitted by the space between walls 21 and 25.

A connecting link 55 has a pair of down-turned ends 56 and 57 which engage in the openings in the bent ends 46 and 48 of the rods 45 and 47 respectively, whereby generally linear movement of the link 55 results in rotation of the rods 45 and 47 to move the intake dampers 40 and 41 between closed and open positions. The link 55 carries a handle 60 extending through a panel 61 of the fireplace with a stem section 62 fastened to the rod 55 and fitted in a slot 63 in the panel 61 whereby the handle 60 may move between open and closed positions at opposite ends of the slot. The handle 60 as shown in FIG. 1 is in an intermediate position.

With the structure disclosed herein the intake dampers may be in closed position to block outside air from the fireplace when the fireplace is not in use. When the fireplace is used, the handle 60 may be shifted to shift the rod 55 linearly and rotate the rods 45 and 47 to open the intake dampers 40 and 41. After use of the fireplace the handle 60 may be returned to initial position to close the intake dampers

We claim:

1. A fireplace having a casing with a panel extending across the bottom thereof and a front opening thereabove and having an internal wall defining a firebox, passage means in the casing for delivery of external combustion air to the firebox including a pair of outlet openings in opposite wall sections of the firebox, an intake damper positioned in each outlet openings, a pair or rotatable rods connected one to each of said intake dampers and extended downwardly and forwardly to have the lower ends of said rods positioned one at each front corner of the fireplace, a link positioned behind said panel and extended across the width of the fireplace and having opposite ends loosely connected one to each of the rod lower ends, and a handle extended through said panel and connected to said link intermediate the ends thereof and operable from the front of the fireplace whereby handle movement causes movement of the link and simultaneous rotation of the rods and movement of the intake dampers.

2. A fireplace having a casing with a panel extending across the bottom thereof and a front opening thereabove and having an internal wall defining a firebox, passage means in the casing for delivery of external combustion air to the firebox including a pair of outlet openings in opposite wall sections of the firebox, an intake damper positioned in each outlet opening, a pair of rods connected one to each of said intake dampers and extended forwardly to have a rod end positioned one at each front corner of the fireplace, a link positioned behind said panel and extended substantially across the width of the fireplace and having opposite ends connected one to each of the rod ends, and a handle extended through said panel and connected to said link intermediate the ends thereof and operable from the front of the fireplace whereby handle movement causes simultaneous movement of the link and rods and resulting movement of the intake dampers.

* * * * *